United States Patent [19]

Cartwright et al.

[11] 4,371,409

[45] Feb. 1, 1983

[54] GELATINIZED HIGH EXPLOSIVE COMPOSITION AND METHOD OF PREPARATION

[75] Inventors: Richard V. Cartwright, Sussex, N.J.; Ronald D. Lees, Bartlesville, Okla.

[73] Assignee: Hercules Incorporated, Wilmington, Del.

[21] Appl. No.: 268,559

[22] Filed: Jun. 1, 1981

[51] Int. Cl.[3] ..... C06B 25/28

[52] U.S. Cl. ..... 149/94; 149/48; 149/38; 149/41; 149/64

[58] Field of Search ..... 149/94, 48, 38, 41, 149/64

[56] References Cited

U.S. PATENT DOCUMENTS

| | | | |
|---|---|---|---|
| 268,559 | 5/1939 | Lawson | 52/13 |
| 3,222,233 | 12/1965 | Matuszko et al. | 149/94 |
| 3,238,074 | 1/1964 | Griffith et al. | 149/2 |
| 3,423,256 | 1/1969 | Griffith | 149/2 |
| 3,489,623 | 1/1970 | Griffith | 149/20 |
| 3,723,208 | 3/1973 | Falconer | 149/94 |

*Primary Examiner*—Stephen J. Lechert, Jr.

[57] ABSTRACT

An explosive composition is provided including as a sensitizer, a mixture of metriol trinitrate and diethylene glycol dinitrate, and including dimethylformamide as a polar compatibility additive.

7 Claims, No Drawings

GELATINIZED HIGH EXPLOSIVE COMPOSITION AND METHOD OF PREPARATION

BACKGROUND OF THE INVENTION

This invention relates generally to the preparation of gelatinized high explosives. It relates particularly to the use of dimethylformamide as a compatibility additive in explosive formulations which include a combination of metriol trinitrate and diethylene glycol dinitrate, as a replacement for nitroglycerine.

DESCRIPTION OF THE PRIOR ART

Gelation of nitroglycerine by nitrocellulose is easily accomplished, and has long been standard practice in dynamite manufacture. However, it is desirable to replace nitroglycerine in dynamite with another component because of the notorious ability of nitroglycerine to produce headaches. A mixture of metriol trinitrate and diethylene glycol dinitrate has been found to be a very promising replacement for nitroglycerine in terms of ease of production, explosive performance and cost. U.S. Pat No. 3,423,256 discloses an explosive sensitizer composition wherein trimethylolethane trinitrate decreases the impact-sensitivity of the composition as compared to use of the liquid nitrated polyol alone while not decreasing the detonator sensitivity. However, gelation of the combination of metriol trinitrate and diethylene glycol dinitrate by nitrocellulose does not proceed at an acceptable rate under reasonable conditions of dynamite manufacture. U.S. Pat. No. 2,159,973 discloses a process for adding an amide, preferably dimethylformamide, to an organic nitrate to accelerate gelatinization. This reference discloses as organic nitrates the use of nitroglycerine and tetranitroglycerine. This patent discloses the acceleration of gelatinization by incorporating with the nitroglycerin an acid amide of a monobasic fatty acid or an alkyl derivative thereof. The acid amide disclosed has the formula

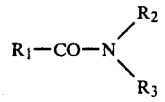

in which $R_1$, $R_2$, and $R_3$ consist either of hydrogen or an alkyl radical. For example, formamide and its alkyl derivatives are known to be desirable accelerants, in which case, $R_1$, represents hydrogen. When $R_1$ represents a $CH_3$ group the accelerant will be acetamide or an alkyl derivative thereof. $R_2$ and $R_3$, likewise, may represent either hydrogen or alkyl groups. Examples of compounds known to be advantageous for use as gelatinization accelerants include formamide ($H—CO—NH_2$), acetamide ($CH_3—CO—NH_2$), monomethylformamide

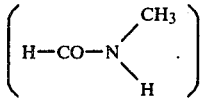

dimethylformamide

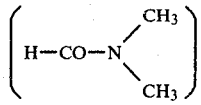

dimethylacetamide ($CH_3—CO—N—(CH_3)_2$), diacetamide ($(CH_3—CO)_2—NH$), propionamide, butylamide, and many others. From this group, dimethylformamide is the preferred gelatinization accelerant.

Gelation of the nitrate ester in dynamite type formulation has a twofold purpose. First, the gel forms a hydrophobic protective coating on water sensitive solids such as ammonium nitrate and sodium nitrate. This coating effect is essential for imparting the water resistance which is needed in wet environments. Secondly, gelation is necessary to prevent separation of the liquid nitrate ester from the rest of the explosive. Separation would greatly reduce the explosive performance and could possibly produce a serious handling hazard because of contamination of the packaging material by the nitrate ester.

SUMMARY OF THE INVENTION

This invention includes adding between 0.05% and 0.20%, based on the overall formulation, of N,N-dimethylformamide as a polar compatibility additive to a mixture of metriol trinitrate and diethylene glycol dinitrate, which is included for explosive sensitization of a non-nitroglycerine dynamite-type explosive formulation. The resulting product has improved consistency and superior water resistance.

In the process of this invention, between 0.05% and 0.20% dimethylformamide is required for dependable enhancement of gelation. Amounts of dimethylformamide in excess of 0.20% would not significantly improve gelation. In fact, amounts in excess of 0.20% would make water resistance worse because of the hydrophilic nature of dimethylformamide. Other polar additives can be used in place of dimethylformamide including formamide, N,N-dimethylacetamide, N-methyl 2-pyrrolidone, and dimethylsulfoxide.

In the composition of this invention, since the metriol trinitrate is more impact sensitive than diethylene glycol dinitrate, the addition of diethylene glycol dinitrate actually lowers the overall impact sensitivity as compared to the disclosure of U.S. Pat. No. 3,423,256, wherein the metriol trinitrate lessens the shock sensitivity of the nitrated polyol. The metriol trinitrate and diethylene glycol dinitrate can be present in ratios between about 95:5 and 5:95. Preferably the ratio should be between about 40:60 and 60:40. More preferably, the metriol trinitrate and the diethylene glycol dinitrate are present in a ratio of about 50:50.

In the process of this invention, for best results, the nitrate esters, dimethylformamide and nitrocellulose should first be premixed separately from the other solid ingredients.

Although there are a number of nitrocellulose solvents, such as acetone and ethyl acetate, which can be added to a mixture of nitrocellulose and nitrate esters to induce gelation, these solvents are not included in the present invention. The quantities required would be high enough to result in a decrease in the explosive sensitivity of the dynamite to an unacceptably low level. The process of this invention will allow dynamite-type formulations which do not contain nitroglycerine, to be kept under water or in a wet environment between 2 and 20 times longer than dynamite-type formulations which do not contain nitroglycerine.

The following examples, in the opinion of the inventors represent preferred embodiments of this invention.

EXAMPLES 1-3

The amounts of ingredients used in these examples are based on the production of 5000 gram experimental batches. 500 grams each of metriol trinitrate and diethylene glycol dinitrate were first mixed with 25 grams of dynamite-grade nitrocellulose and the amount of dimethylformamide shown in Table I, below, for 5 minutes. The following dry ingredients were mixed together in a separate container: 1,239.5 grams of sodium nitrate, screened through a six mesh screen; 143 grams balsa dust; 143 grams tamarind seed flour; 21.5 grams powdered chalk; and the amount of ammonium nitrate shown in Table I after being passed through a 10 mesh screen. In the process of this invention, the liquid and dry ingredients were then mixed together for approximately 5 minutes. The mixtures were then packed into waxed paper shells, 8 inches in length and having a diameter of 1.25 inches.

The water resistance of the product was determined by finding the maximum length of time that a cartridge could be kept under 11.5 feet of water and still be detonated by a number 6 blasting cap. The results of those tests are shown in Table I.

TABLE I

| EXAMPLE NO. | DIMETHYLFORMAMIDE, GRAMS | DIMETHYLFORMAMIDE, PERCENT | AMMONIUM NITRATE GRAMS | LONGEST TIME FOR DETONATION, HOURS | SHORTEST TIME FOR FAILURE, HOURS |
|---|---|---|---|---|---|
| CONTROL | 0 | 0 | 2428 | 1* | 6 |
| 1 | 2.5 | .05 | 2425.5 | 24 | 48 |
| 2 | 5.0 | .10 | 2423 | 72 | 96 |
| 3 | 7.5 | .15 | 2420.5 | 96 | 120* |

*Estimate

These results show the effect of dimethylformamide as a compatibility additive in improving the water resistance of the formulations shown in Table I.

EXAMPLES 4-7

A series of experiments were conducted which disclosed an improvement in semi-gelatin consistency with increasing use of dimethylformamide. A series of four 7,000 gram mixtures were prepared, each mixture containing equal amounts of diethylene glycol dinitrate and metriol trinitrate. In addition, 0.3% dynamite-grade nitrocellulose, 50% ammonium nitrate, screened through a 24 mesh screen, 16.2% sodium nitrate screened through a 10 mesh screen, 0.5% wood flour, 1.5% balsa dust, 2% tamarind flour, 10% sodium chloride, 0.5% powdered chalk, and 1.0% Alcoa 1651 aluminum was used. The amount of dimethylformamide in each test is shown in Table 2.

The nitrate esters and dimethylformamide were first combined, and then nitrocellulose was then added and mixed for five minutes. The solid ingredients, with the exception of aluminum, were added slowly while stirring. The aluminum was then added and combined throughly by mixing for three minutes. The formulation was then packed into paper shells, each having a diameter of 1.25 inches.

Each cartridge shell was then unrolled, and a 3 inch length of the explosive material was cut. In the test, one end of each 3 inch stick of explosive was pushed against a hard surface until it assumed the shape of a mushroom. It was then inverted. If the mushroom disintegrated, the semi-gelatin quality was considered to be poor. Semi-gelatin quality was considered to be good if the integrity of the mushroom shape is maintained.

TABLE II

| EXAMPLE NO. | METRIOL TRINITRATE % | DIETHYLENE GLYCOL DINITRATE % | DIMETHYLFORMAMIDE % | SEMI-GELATIN QUALITY |
|---|---|---|---|---|
| CONTROL | 9 | 9 | 0 | Poor |
| 4 | 8.975 | 8.975 | 0.05 | Fair |
| 5 | 8.950 | 8.950 | 0.10 | Good |
| 6 | 8.900 | 8.900 | 0.20 | Good |

These results demonstrate that the addition of dimethylformamide improves the consistency of the packed material. In turn, good consistency usually results in enhanced water resistance.

Gelation of a liquid polymer requires substantial polymer-solvent interaction. The polymer and solvent interact well if their polarities are well matched. It is believed that nitroglycerine and nitrocellulose have comparable polarities while the metriol trinitrate/diethylene glycol dinitrate mixture is appreciably less polar than nitrocellulose. However, dimethylformamide is a highly polar solvent as well as a solvent for nitrocellulose. Therefore, the addition of dimethylformamide to the metriol trinitrate/diethylene glycol dinitrate mixture can be increase its overall average polarity to a point where it is comparable to that of nitrocellulose. In effect, the addition of dimethylformamide increases the affinity of nitrocellulose for the metriol trinitrate/diethylene glycol dinitrate combination and performs as a compatibility additive for these two constituents.

Dynamite-type formulations manufactured by the process of this invention are expected to have significant utility as a substitute for conventional dynamite, i.e. in mining, tunneling, ditching, construction, seismic exploration and other applications.

It is to be understood that the above description and examples are illustrative of this invention and not in limitation thereof. As will be evident to those skilled in the art, various modifications can be made in light of the foregoing disclosure and discussion without departure from the spirit or scope of the disclosure or from scope of the claims.

What we claim and desire to protect by Letters Patent is:

1. A high explosive composition comprising:

an explosive sensitizer composition consisting essentially of an amount within the range of about 5% to 95% of a liquid nitrated polyol derived from an aliphatic polyol having from 2 to about 6 alcoholic hydroxyl groups and from 2 to about 10 carbon atoms and an amount with the range from about 95% to about 5% of metriol trinitrate, said sensitizer composition gelatinized by nitrocellulose and a polar compatibility additive taken from the group consisting of dimethylformamide, formamide, N,N-dimethylacetamide, N-methyl-2-pyrrolidone and dimethylsulfoxide.

2. A high explosive composition in accordance with claim 1 including in addition an inorganic oxidizer salt.

3. A high explosive composition in accordance with claim 1 or 2 wherein said nitrated polyol is diethylene glycol dinitrate and said diethylene glycol dinitrate and said metriol trinitrate are present in a ratio of between about 60:40 and about 40:60.

4. The explosive composition of claim 3 wherein the polar compatibility additive is dimethylformamide which is present in an amount between about 0.05% and 0.20% of said explosive composition.

5. The process of enhancing compatibility between nitrocellulose and a combination of metriol trinitrate and diethylene glycol dinitrate, which process comprises adding a polar compatibility additive taken from the group consisting of dimethylformamide, formamide, N,N-dimethylacetamide, N-methyl-2-pyrrolidone and dimethylsulfoxide.

6. The process of claim 5 wherein said compatibility additive is dimethylformamide.

7. The process of claim 6 wherein said dimethylformamide is added in an amount between about 0.05% and about 0.20%.

* * * * *